United States Patent [19]

Bartolo et al.

[11] Patent Number: 4,916,420

[45] Date of Patent: Apr. 10, 1990

[54] OPERATING MECHANISM OF A MINIATURE ELECTRICAL CIRCUIT BREAKER

[75] Inventors: William Bartolo; Michel Lazareth, both of Eybens, France

[73] Assignee: Merlin Gerin, France

[21] Appl. No.: 194,901

[22] Filed: May 17, 1988

[30] Foreign Application Priority Data

Jun. 9, 1987 [FR] France ..... 87 08037

[51] Int. Cl.[4] ..... H01H 9/00

[52] U.S. Cl. ..... 335/172; 335/21; 335/189

[58] Field of Search ..... 335/17.21, 169–174, 335/175–177, 185, 187, 188, 189

[56] References Cited

U.S. PATENT DOCUMENTS 4,344,054 8/1982 Castonguay et al. ..... 335/169

*Primary Examiner*—Leo P. Picard

*Assistant Examiner*—Lincoln Donovan

*Attorney, Agent, or Firm*—Arnold, White & Durkee

[57] ABSTRACT

An operating mechanism of an electrical circuit breaker comprises a handle coupled to a transmission rod to form a toggle, a movable contact support device having a plate mounted with rotation on a pivot, and a mechanical link breakable by the action of a trip lever. The link is formed by a retaining catch of the trip lever cooperating with a latch pivotally mounted on a spindle of the plate. The rod is coupled directly to the latch, the assembly constituting a gearing-down stage enabling the tripping force to be reduced. The bimetal strip is connected to the trip lever by a rotating tie-rod with unidirectional transmission.

6 Claims, 4 Drawing Sheets

OPERATING MECHANISM OF A MINIATURE ELECTRICAL CIRCUIT BREAKER

BACKGROUND OF THE INVENTION

The invention relates to an operating mechanism of a miniature electrical circuit breaker with a molded case housing a pair of stationary and movable contacts, said movable contact being supported by a contact arm actuated by the mechanism between a closed position and an open position, the mechanism comprising :

a manual operating handle coupled to a transmission rod to form a toggle, a support lever of the contact arm articulated on a pivot of a rotating plate, a relative pivoting movement of small amplitude being allowed between the plate and the support lever due to the presence of a contact pressure spring, a breakable mechanical link arranged between the plate and the transmission rod, a trip lever articulated on the plate and being controlled by the trip device to cause breaking of said mechanical link in the event of a fault occurring, resulting in automatic tripping of the mechanism, independently from the handle.

A device of this kind is known from the document EP No. 244,396, wherein the breakable mechanical link is constituted by a notch of the plate designed to cooperate directly with the cylindrical end of the transmission rod in the set position of the mechanism. A mechanism of this kind is perfectly suited to circuit breakers with low ratings, but for higher ratings the tripping force required to break the mechanical link would be too great, and would lead to oversizing of the trip device, which is impossible because of the small dimensions of the case. According to the documents EP-A-No. 144,691, DE-A-No. 1,904,731 and DE-U-No. 7500060, an intermediate latch and the trip lever of the mechanism are articulated directly on the contact arm. Such an assembly requires great precision of the mechanism components to achieve a good contact pressure.

The object of the invention consists in making a miniature circuit breaker mechanism with a reduced tripping force and good contact pressure simpler to achieve.

SUMMARY OF THE INVENTION

The mechanism according to the invention is characterized in that the breakable mechanical link is formed by a retaining catch of the trip lever cooperating with a latch pivotally mounted on a spindle of the plate, and that the transmission rod is coupled to the latch at an articulation point offset from the axis of said latch.

The mechanical link with the latch constitutes a gearing-down stage in the mechanism tripping transmission system allowing the tripping force coming from the thermal-magnetic trip device to be reduced.

According to a development of the invention, the bimetal strip is connected to the trip lever by a rotating tie-rod with uni-directional transmission arranged to constitute a rigid transmission link without friction with the trip lever when the bimetal strip drives the tie-rod in the event of overload tripping, said link being automatically interrupted when the plate is moved to the open position of the contacts, or when the striker acts on the trip lever in the event of short-circuit tripping.

According to another development of the invention, the mechanism latch cooperates after tripping with a ratcheting hangup point arranged in the trip lever in such a way as to block the latch in a fault indication position.

Two indications of a fault after tripping are possible :

one direct by the latch having a mark coming opposite an indicator of the case, the other by the handle which is blocked positively by the rod in a stable intermediate position located between the closed and open positions, when the latch is locked by the hangup point after tripping, non-automatic resetting of the mechanism being performed by moving the handle manually from the intermediate position to the open position leading on the one hand to the mechanical link between the handle and the plate being re-established, and on the other hand to the fault indication being cleared.

BRIEF DESCRIPTION OF THE DRAWINGS

Other advantages and features will become more clearly apparent from the following description of two illustrative embodiments of the invention, given as non-restrictive examples only and represented in the accompanying drawings, in which.

DESCRIPTION OF THE PREFERRED EMBODIMENT

Figure 1:
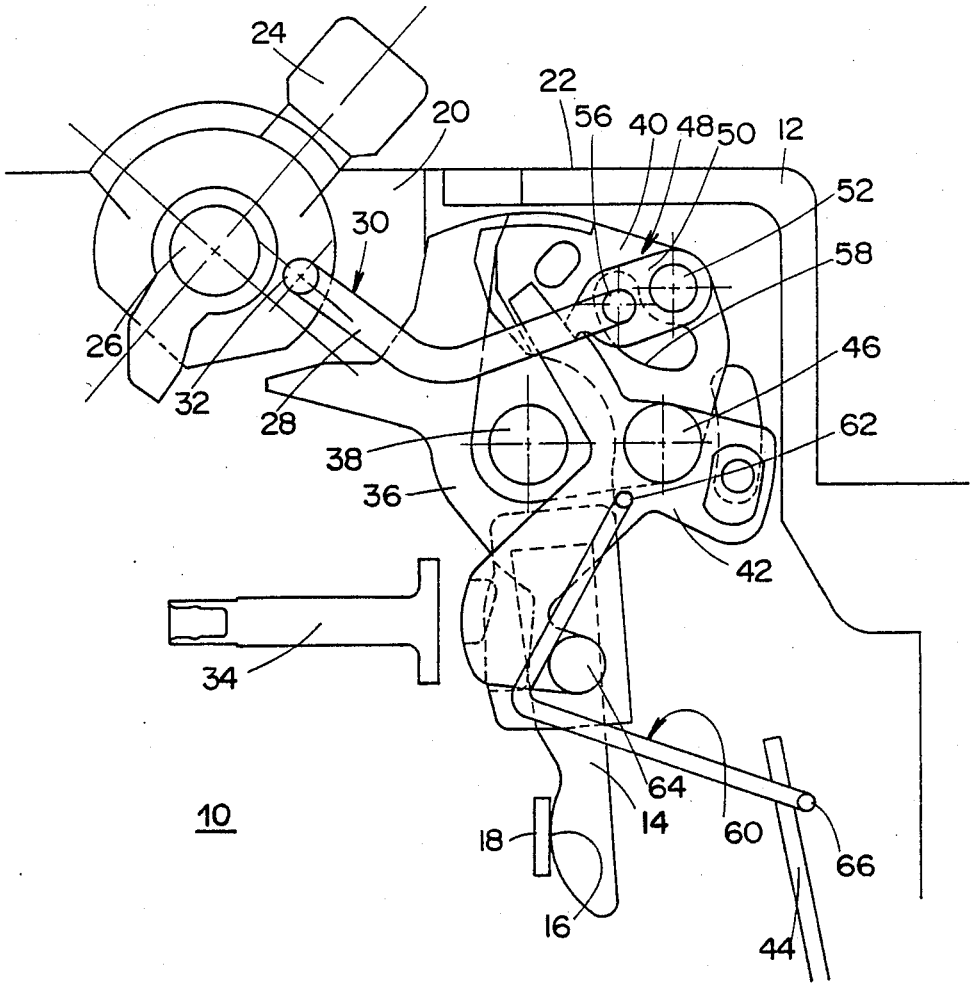
FIG. 1 is a schematic view of a first embodiment of the mechanism according to the invention, represented in the circuit breaker closed position.
Figure 2:
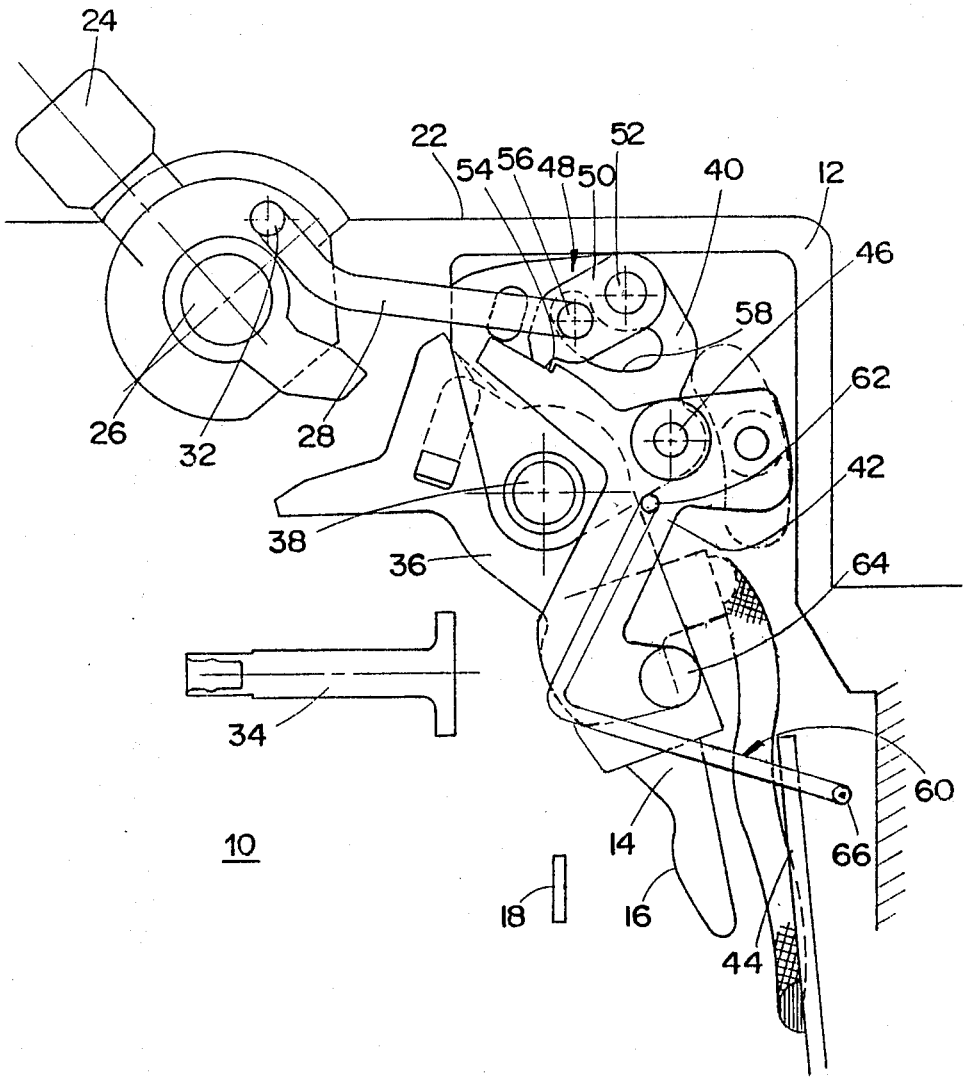
FIG. 2 is an identical view to that of FIG. 1, in the circuit breaker open position.
Figure 3:
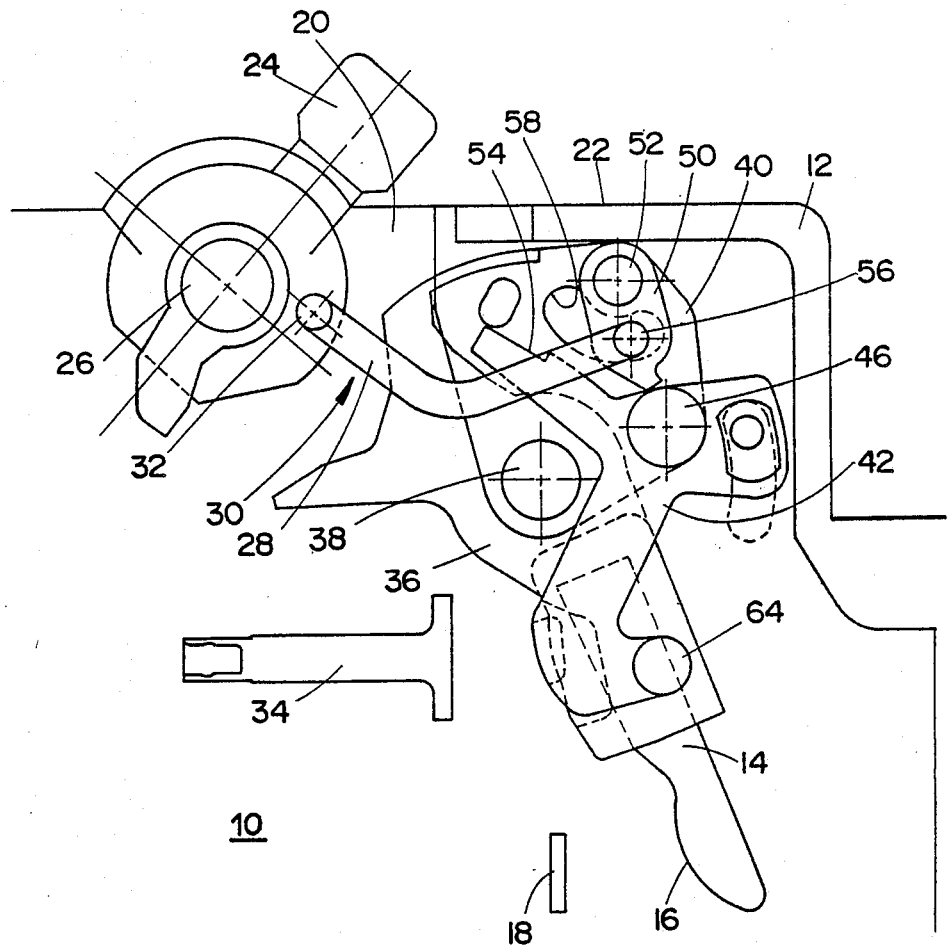
FIG. 3 is an identical view to that of FIG. 1, in the tripped position on a fault with the handle held.

In FIGS. 1 to 3, the operating mechanism 10 of a miniature electrical circuit breaker with a molded insulating case 12 is of the type described in European Patent application No. 224,396 filed by the applicant. The mechanism 10 actuates a movable contact arm 14 whose free end supports a contact part 16 cooperating with a stationary contact 18. An opening 20 is arranged in the front panel 22 of the case 12 for a handle 24 to pass through mounted with limited pivoting on a spindle 26 between a closed position (FIG. 1) in which the contacts 16, 18 are closed, and an open position (FIG. 2) corresponding to separation of the contacts 16, 18. The handle 24 is equipped with an internal base coupled to a transmission rod 28 to constitute a toggle device 30 whose articulation 32 is eccentric with respect to the fixed spindle 26 of the handle 24.

The handle 24 is biased counterclockwise to the open position by a return spring (not shown). The stationary contact 18 is securedly united to the body of the electromagnetic trip device only the striker 34 of which is represented in the figures. The contact arm 14 is fixed to a support lever 36 made of insulating material, articulated on a pivot 38 of a rotating plate 40. In the closed position of the contacts 14, 16, a contact pressure spring (not shown), inserted on the pivot 38, allows a relative pivoting movement of small amplitude between the plate 40 and the support lever 36.

A trip lever 42 controlled by the electromagnetic trip device striker 34, and the bimetal strip 44 of the thermal trip device, is pivotally mounted on a spindle 46 supported by the plate 40 with a preset stagger with respect to the pivot 38.

A breakable mechanical link 48 is arranged between the transmission rod 28 and the drive plate 40 of the contact arm 14. In the locked position, the link 48 allows the mechanism 10 to be controlled manually by the handle 24. The trip lever 42 moving to the tripped position due to the action of the trip device causes the mechanical link 48 to be momentarily broken, leading to automatic tripping of the mechanism 10, independently from the handle 24. The trip lever 42 is associated with a return spring (not shown) designed to ensure that the mechanical link 48 is automatically re-established when the handle 24 is actuated to the open position, subsequent to tripping of the mechanism 10 on a fault.

Operation of an operating mechanism of this kind is well-known to those skilled in the art, and it is not necessary to describe it in greater detail here.

According to the invention, the breakable mechanical link 48 comprises a latch 50 pivotally mounted on a spindle 52 of the plate 40. Opposite the spindle 52, the nose of the latch 50 cooperates in the locked position of the link 48 with a retaining catch 54 located on the upper arm of the trip lever 42.

The transmission rod 28 is coupled to the latch 50 at an articulation point 56 capable of moving in an aperture 58 of the plate 40 when tripping occurs. The aperture 58 is blind or open and is shaped in a circular sector centered on the spindle 52. The intermediate articulation point 56 is located between the spindle 52 and the nose of the latch 50. The link 48 constitutes a gearing-down stage in the transmission system of the mechanism 10, enabling the tripping force from the magnetic and thermal trip device to be reduced.

The bimetal strip 44 of the thermal trip device cooperates with the trip lever 42 by means of a rotating tie-rod 60 with uni-directional transmission (see FIGS. 1 and 2). The tie-rod 60 is formed by an elbow lever having one end freely coupled to the lower arm of the trip lever 42 at an articulation point 62. The curved intermediate part of the transmission lever bears on a boss 64 of the trip lever 42 so as to drive the latter to the tripped position when the bimetal strip 44 is deflected to the right in the event of an overload current flowing in the pole. During this overload tripping phase, the tie-rod 60 forms a rigid transmission link between the bimetal strip 44 and the trip lever 42. The absence of nuisance friction between the tie-rod 60 and the trip lever 42 enables the tripping force transmitted by the bimetal strip 44 to be appreciably reduced. The articulation point 62 is arranged between the boss 64 and the pivoting axis 46 of the trip lever 42.

When the mechanism 10 is actuated manually or automatically to the open position, the end 66 of the tie-rod 60 opposite the articulation point 62 is capable of coming up against a protuberance of the case 12, with the transmission link with the trip lever 42 being interrupted. The plate 40 can pivot counterclockwise around the pivot 38, and the intermediate zone of the tie-rod 60 is then located away from the boss 64 (figure 2). It can be noted that if the link remained rigid between the tie-rod 60 and the trip lever 42, total opening of the mechanism 10 would be rendered impossible.

The articulation point 62 of the tie-rod 60 could naturally be the same as the pivoting axis 46 of the trip lever 42.

In the event of magnetic tripping following a short-circuit, the electromagnetic trip device striker 34 acts on the lower arm of the trip lever 42 to perform unlocking of the latch 50 by its being released from the retaining catch 54. The trip lever 42 is thus moved counterclockwise to the tripped position, without any braking reaction of the overload trip tie-rod 60 which remains inactive due to the presence of the flexible link with the bimetal strip 44.

FIG. 3 shows the mechanism 10 after tripping on a fault, the handle 24 being held manually in the right-hand position, against the return force of its spring. This position of the handle 24 corresponds to the closed position in FIG. 4, but the rod 28 does not allow the mechanical link 48 of the latch 50 with the catch 54 of the trip lever 42 to be re-established, and the mechanism 10 remains tripped. The mechanical link 48 is re-established automatically as soon as the manual locking action of the handle 24 is released.

Figure 4:
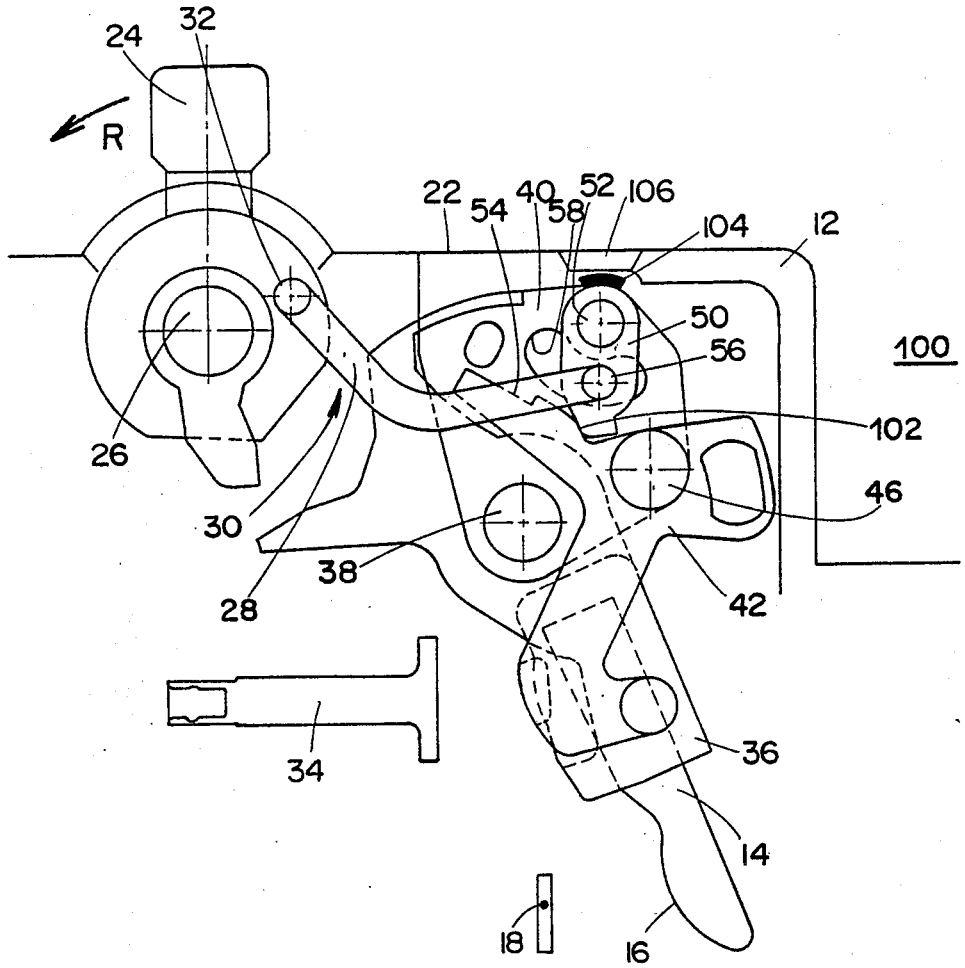
FIG. 4 represents an alternative embodiment of a mechanism with a tripping indicator.

According to the alternative embodiment of the mechanism 100 in FIG. 4, the same reference numbers will be used to designate similar parts to those of the mechanism 10 in FIGS. 1 to 3. In addition to its two extreme open and closed positions, the pivoting handle 24 can occupy a stable intermediate position (case of FIG. 4) after tripping on an overload or shortcircuit fault. The trip lever 42 comprises a ratcheting hangup point 102 capable of blocking the latch 50 after tripping and breaking of the mechanical link 48. Opposite the nose there is located a coloured mark 104 designed to indicate the tripped position of the latch 50 via an indicator 106 arranged in the front panel 22 of the case 12. Blocking of the latch 50 by the hangup point 102 enables the fault to be continuously indicated, both by the indicator 106 and by the handle 24 which occupies the intermediate stable position. The fault indicator function is thus integrated in the circuit breaker.

Non-automatic resetting of the mechanism 100 is achieved by manual movement of the handle 24 counterclockwise from the intermediate position to the open position (see arrow R), resulting in the mechanical link 48 between the handle 24 and the plate 40 being re-established, and the mechanism 100 returning to the open switchgear status of FIG. 2. The fault indication disappears and the switchgear device is ready to be reclosed by pivoting of the handle 24 to the closed position (FIG. 1).

We claim:

1. An operating mechanism of a miniature electrical circuit breaker with a molded case housing a pair of stationary and movable contacts, said movable contact being supported by a contact arm actuated by the mechanism between a closed position and an open position, said mechanism comprising:

a manual operating handle coupled to a transmission rod to form a first toggle;

a trip device comprising a thermal overload trip device with a bimetal strip, and/or an electromagnetic trip device with a striker;

a support lever of the contact arm articulated on a pivot of a rotating plate, a relative pivoting movement of small amplitude being allowed between the plate and the support lever due to the presence of a contact pressure spring;

a breakable mechanical link arranged between the plate and the transmission rod;

a trip lever pivotally mounted on the plate and having a first arm controlled by the trip device to cause breaking of said mechanical link in the event of a fault occurring, resulting in automatic tripping of the mechanism, independently from the handle;

a second arm of the trip lever having a retaining catch cooperating with a latch pivotally mounted on a first spindle of the plate, so as to form the breakable mechanical link;

a second spindle of said pivoting trip lever being supported by the plate with a present stagger with respect to the pivot;

and a second toggle formed by the transmission rod coupled to the latch at an intermediate articulation point located between the first spindle and the nose of said latch.

2. An operating mechanism according to claim 1, having a blind or open aperture arranged in the plate for allowing said intermediate articulation point to move when tripping occurs, said aperture being shaped as a circular sector centered on the first spindle of said latch.

3. An operating mechanism according to claim 1, comprising:

a ratcheting hangup point arranged on the trip lever so as to block the latch in a fault indication position, the handle being blocked positively by said transmission rod in a stable intermediate position located between the closed and open positions, when the latch is locked by the hangup point after tripping, non-automatic resetting of the mechanism being achieved by manual movement of the handle from the intermediate position to the open position leading on the one hand to the mechanical link between the handle and the plate being re-established, and on the other hand to the fault indication being cleared;

and a mark of said latch coming opposite an indicator of the case in said fault indication position.

4. An operating mechanism of a miniature electrical circuit breaker with a molded case housing a pair of stationary and movable contacts, said movable contact being supported by a contact arm actuated by the mechanism between a closed position and an open position, said mechanism comprising:

a manual operating handle coupled to a transmission rod to form a first toggle;

a trip device comprising a thermal overload trip device with a bimetal strip, and/or an electromagnetic trip device with a striker;

a support lever of the contact arm articulated on a pivot of a rotating plate, a relative pivoting movement of small amplitude being allowed between the plate and the support lever due to the presence of a contact pressure spring;

a breakable mechanical link arranged between the plate and the transmission rod;

a trip lever pivotally mounted on the plate and having a first arm controlled by the trip device to cause breaking of said mechanical link in the event of a fault occurring, resulting in automatic tripping of the mechanism, independently from the handle;

a second arm of the trip lever having a retaining catch cooperating with a latch pivotally mounted on a first spindle of the plate, so as to form the breakable mechanical link;

a second spindle of said pivoting trip lever being supported by the plate with a present stagger with respect to the pivot;

an intermediate articulation point located between the first spindle and the nose of said latch for coupling the transmission rod to the latch;

a rotating tie-rod with unidirectional transmission connecting the bimetal strip to the trip lever so as to constitute a rigid frictionless transmission link with the trip lever when the bimetal strip drives the tie-rod in the event of overload tripping said transmission link being automatically interrupted when plate is moved to the open position of the contacts, or when the striker acts on the trip lever in the event of short-circuit tripping.

5. An operating mechanism according to claim 4, wherein said rotating tie-rod is formed by an elbow lever having one end freely articulated on an articulation point of the trip lever, and a curved intermediate part bearing on a boss of the trip lever in the active position of said transmission link.

6. An operating mechanism according to claim 5, wherein said articulation point of the rotating tie-rod is located between the boss and the second spindle of the trip lever, the opposite end of the tie-rod being capable of coming up against a protuberance of the case to break said transmission link with the trip lever.

* * * * *